US011774135B2

(12) United States Patent
Ciuricov

(10) Patent No.: US 11,774,135 B2
(45) Date of Patent: Oct. 3, 2023

(54) AIR DIFFUSER ASSEMBLY

(71) Applicant: Victor Ciuricov, Las Vegas, NV (US)

(72) Inventor: Victor Ciuricov, Las Vegas, NV (US)

( * ) Notice: Subject to any disclaimer, the term of this patent is extended or adjusted under 35 U.S.C. 154(b) by 0 days.

(21) Appl. No.: 17/852,798

(22) Filed: Jun. 29, 2022

(65) Prior Publication Data

US 2022/0412602 A1 Dec. 29, 2022

Related U.S. Application Data

(60) Provisional application No. 63/216,085, filed on Jun. 29, 2021.

(51) Int. Cl.
*F24F 13/078* (2006.01)
*F24F 13/075* (2006.01)
*F24F 13/28* (2006.01)

(52) U.S. Cl.
CPC ..... *F24F 13/078* (2013.01); *F24F 13/075* (2013.01); *F24F 13/28* (2013.01)

(58) Field of Classification Search
CPC ..... F24F 13/075; F24F 13/078; F24F 13/28
USPC ..... 454/284
See application file for complete search history.

(56) References Cited

U.S. PATENT DOCUMENTS 5,573,458 A * 11/1996 Chu ..... F24F 13/075 454/316
5,597,392 A * 1/1997 Hawkins ..... F24F 13/28 55/DIG. 35
6,030,427 A * 2/2000 Sorice ..... B01D 46/10 55/DIG. 35
6,234,893 B1 * 5/2001 Meredith ..... F24F 13/28 454/289
6,379,412 B1 * 4/2002 Porterfield ..... B01D 46/88 55/DIG. 35
6,814,660 B1 * 11/2004 Cavett ..... B01D 46/10 454/284
7,789,928 B2 * 9/2010 Stepp ..... B01D 46/10 55/DIG. 35
9,333,450 B2 * 5/2016 Hamlin ..... B01D 46/0016
9,644,862 B1 * 5/2017 Korte ..... F24F 13/0209
10,072,869 B2 * 9/2018 Zakula ..... F24F 13/078
10,940,417 B1 * 3/2021 Bishop ..... B01D 46/0006
2014/0141709 A1 * 5/2014 Hammer ..... F24F 13/082 454/284
2015/0292755 A1 * 10/2015 Pickett ..... F24F 8/192 55/482

* cited by examiner

*Primary Examiner* — Avinash A Savani
*Assistant Examiner* — Dana K Tighe
(74) *Attorney, Agent, or Firm* — Kevin D. Everage; Dickinson Wright PLLC

(57) ABSTRACT

An air diffuser assembly for transferring airflow from an HVAC system to an environment. The air diffuser assembly comprises a body at least partially located in a duct of the HVAC system and a cover including at least one vent assembly for permitting airflow through the cover and into the environment. The body defines an aperture for transferring airflow from the duct and an air filter is located in the aperture for filtering air transferred therethrough. The cover includes a closed position, wherein the cover is placed against the body to form a cavity, and an open position, wherein the cover is moved from the body to permit access to the filter.

18 Claims, 9 Drawing Sheets

AIR DIFFUSER ASSEMBLY

PRIORITY CLAIM

This application claims priority to U.S. Provisional patent application No. 63/216,085 entitled "AIR DIFFUSER ASSEMBLY", filed on Jun. 29, 2021, which application is expressly incorporated by reference herein.

BACKGROUND OF THE INVENTION

1. Field of Invention

The present invention relates to an air diffuser assembly for residential and commercial environments.

2. Introduction

This section provides background information related to the present disclosure which is not necessarily prior art.

Most modern residential and commercial buildings include heating, ventilation, and air condition (HVAC) systems. These HVAC systems control environmental factors such as temperature, humidity, and air quality via the circulation and redistribution of air through a manifold of air ducts. Movement of air is typically facilitated by at least one blower located within the manifold and the air can be thermally regulated before distribution by heating and cooling appliances. The air moves through the air ducts and into a room via a register that diffuses the air in various directions as it flows therethrough. The complexity of the HVAC system typically correlates with the number of distinct locations that are being regulated. For example, in small residential buildings, the HVAC system can be relatively uncomplicated as the air in only a small number of rooms needs to be regulated. In larger commercial properties, however, the HVAC system can be complicated to achieve numerous simultaneous requirements. For example, some areas within a commercial property may need to be cooled while others need to simultaneously be heated.

When air is being circulated and redistributed between numerous areas, concerns begin to arise about the transfer of germs and a degradation of air quality. Typically, HVAC systems include an air filter near the blower to improve air quality. While these air filters exhibit benefits to air quality, they can quickly become dirty and nonoptimal. More particularly, by locating the air filter near the blower, it is positioned to clean all the air at a central location in the manifold. In addition, because these typical air filters are located near the blower, they are under constant or near constant exposure to air at high speeds, thus decreasing effectiveness and blowing debris out of the air filter once it become dirty.

As such, there is a continuing desire to develop assemblies that improve upon air filtration within HVAC systems.

SUMMARY OF THE DISCLOSURE

This section provides a general summary of the disclosure and should not be interpreted as a complete and comprehensive listing of all the objects, aspects, features and advantages associated with the present disclosure.

It is therefore an aspect of the present disclosure to provide an air diffuser assembly for transferring airflow from a duct to an environment. The air diffuser assembly comprises a body for being at least partially located in the provided duct and a cover including at least one vent assembly for permitting airflow through the cover and into the environment. The body defines an aperture for transferring airflow from the duct and an air filter located in the aperture. The cover includes a closed position, wherein the cover is placed against the body to form a cavity, and an open position, wherein the cover is moved from the body to permit access to the filter.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

Other aspects of the present disclosure will be readily appreciated, as the same becomes better understood by reference to the following detailed description when considered in connection with the accompanying drawings wherein.

DETAILED DESCRIPTION

Example aspects will now be described more fully with reference to the accompanying drawings. In general, the subject aspects are directed to an air diffuser assembly for residential and commercial environments. However, the example embodiments are only provided so that this disclosure will be thorough, and will fully convey the scope to those who are skilled in the art. Numerous specific details are set forth such as aspects of specific components, devices, and methods, to provide a thorough understanding of aspects of the present disclosure. It will be apparent to those skilled in the art that specific details need not be employed, that example aspects may be embodied in many different forms and that neither should be construed to limit the scope of the disclosure. In some example aspects, well-known processes, well-known device structures, and well-known technologies are not described in detail.

Referring to the Figures, wherein like numerals indicate corresponding parts throughout the several views, an air diffuser assembly is provided. The air diffuser assembly provides an improvement over the art by providing an internal filter, a flow adjustment mechanism, and additional functional mechanisms.

Figure 1:
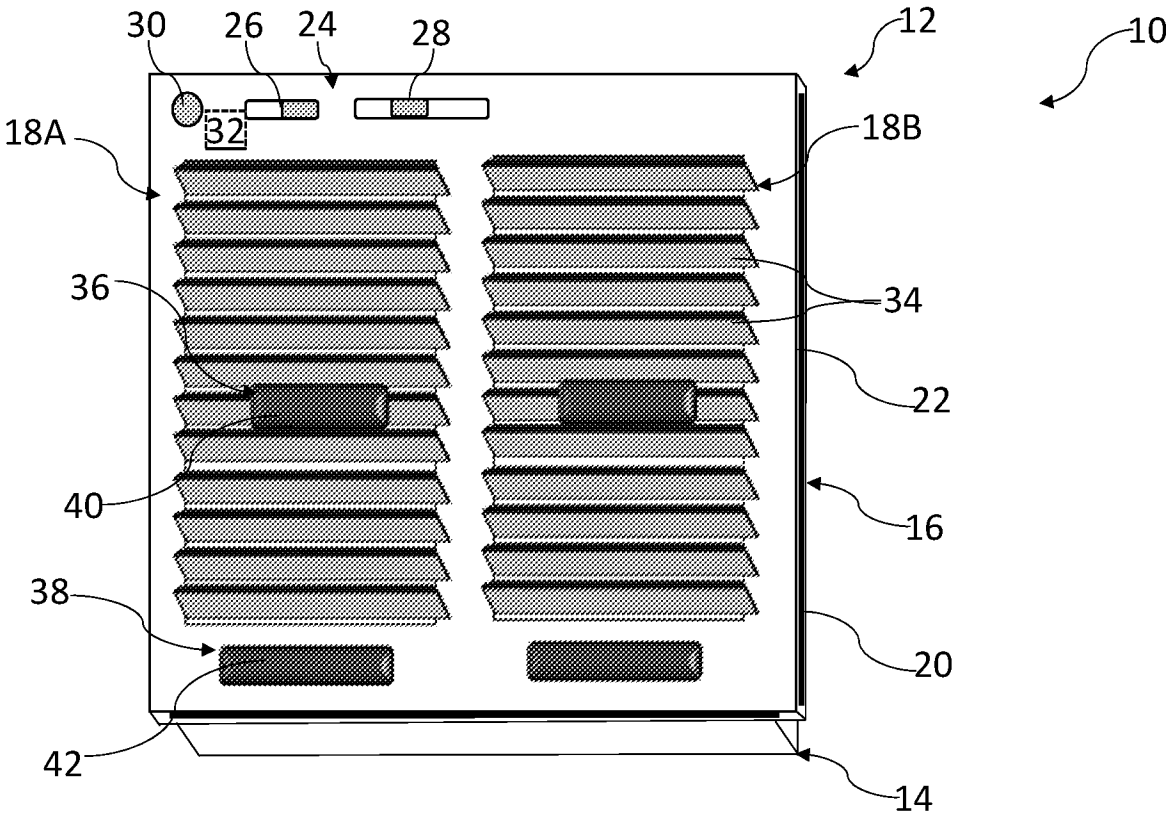
FIG. 1 is a perspective view of an air diffuser assembly in a closed position according to an aspect of the present disclosure.

Referring initially to FIG. 1, the air diffuser assembly 10 is generally illustrated. The air diffuser assembly 10 includes a housing 12 including a body 14 and a cover 16. The housing 12 includes a closed position (FIG. 1), wherein the cover 16 is placed directly over the body 14 and an open position (FIG. 2), wherein the cover 16 is pivoted away from the body 14. The cover 16 includes at least one air vent assembly 18 for directing an airflow through the cover 16. As will be described in further detail below, in some embodiments, the at least one air vent assembly 18 includes a plurality of air vent assemblies 18A, 18B, etc., that can be adjusted to direct air in a same direction or transverse directions.

The cover 16 includes at least one source of illumination 20. In some embodiments, the cover 16 includes an outer peripheral sidewall 22 defining a thickness and the source of illumination 20 is located on the peripheral sidewall 22. The source of illumination 20 may include light bulbs, LEDs, LED strips, electroluminescent material, other illumination means, or a combination thereof. In some embodiments, the source of illumination 20 extends over a majority of the peripheral sidewall 22. For example, the peripheral sidewall 22 may include four sections defining a rectilinearly shaped (e.g., rectangular) cover 16 and the source of illumination 20 may include a source of illumination 20 located on each of the four sections and extending over a majority of each of the four sections.

The cover 16 may further include a user interface 24 that includes a settings selector 26 and a brightness selector 28. The setting selector 26 may permit a user to change one or more illumination settings of the source of illumination 20. The illumination settings may include on/off settings for motion sensing, light detection, scheduled illumination, color of illumination, or combinations thereof. The cover 16 may further include one or more sensors 30, such as a motion sensor, an illumination sensor, or combinations thereof. Functionalities of the user interface 24 and sensors 30 may be controlled via a control system 32, for example, a PCB with a controller including a processor and a memory containing instructions that, when executed by the processor, cause the processor to perform the methods, systems, and functionalities as described herein.

With continued reference to FIG. 1, each of the air vent assemblies 18 may include a plurality of outer blades 34 for directing the airflow in a first direction and a plurality of inner blades 35 (FIG. 4) for directing the airflow in a second direction. As will be described in detail below, each of the vent assemblies 18 may further include a directional control 36 for adjusting the plurality of outer blades 24, the plurality of inner blades 35, and ultimately the direction of the airflow. Each of the vent assemblies 18 may further include a flow control 38 for adjusting an internal flow valve 37 and controlling the rate at which air is moved therethrough. In some embodiments, the directional control 36 may include a tab 40 connected to one of the outer blades 34 and the inner blades 35 and the flow control 38 may include a flow adjustment wheel 42.

Figure 2:
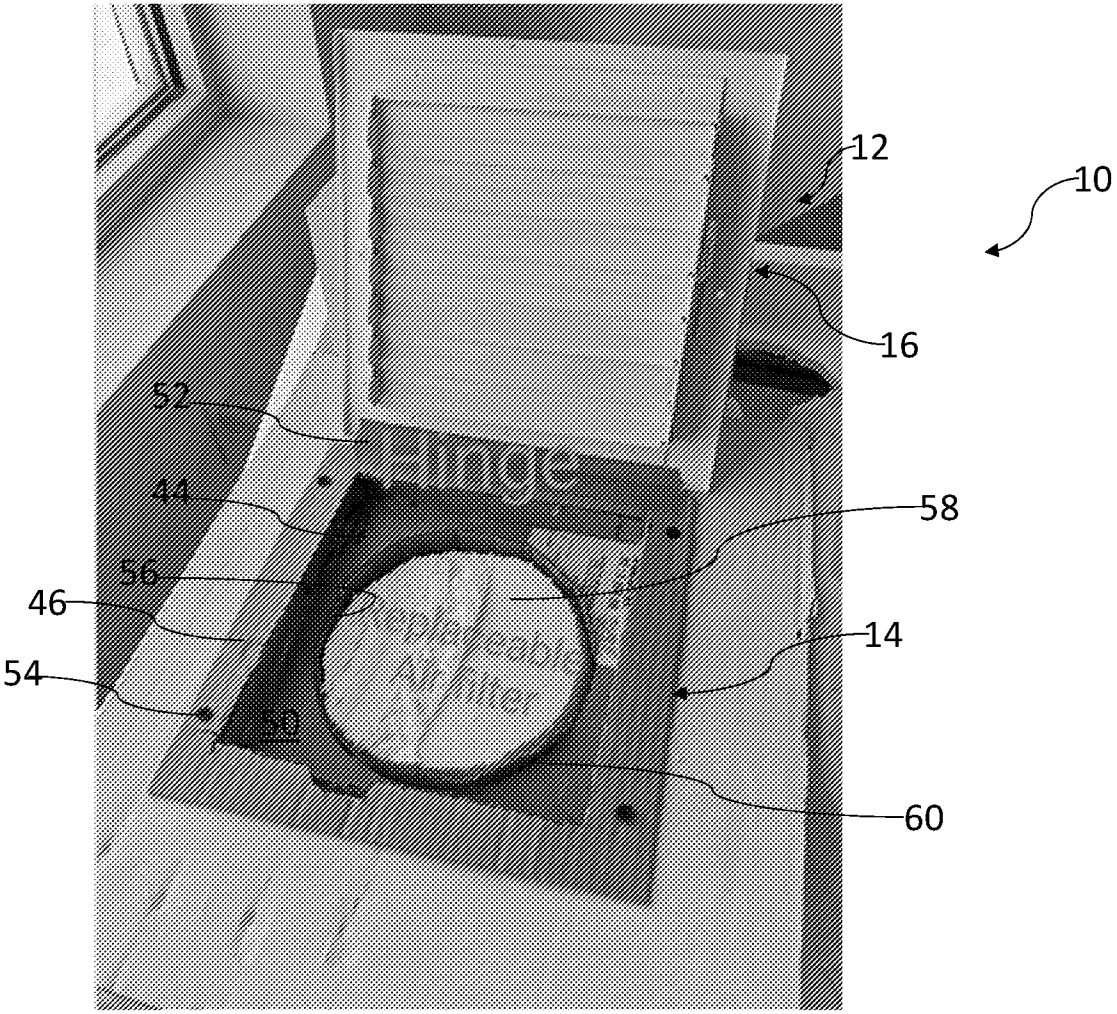
FIG. 2 is a perspective view of the air diffuser assembly in an open position according to an aspect of the present disclosure.

With reference now to FIG. 2, the air diffuser assembly 10 is illustrated in the open position. The body 14 includes a floor 44, a top flange 46, and a sidewall 48 extending from the floor 44 to the top flange 46. The body 14 and the cover 16 define a cavity 50 for locating various element of the air vent assemblies 18 and the control system 32. The body 14 connects to the cover 16 with at least one hinge 52. During installation, the sidewall 48 is sized to be located within an HVAC duct and the top flange 46 abuts a wall wherein it can be fastened thereto with fasteners 54. The floor 44 defines a floor aperture 56 for transferring airflow from the HVAC duct to the environment. At least one filter 58 is located within the floor aperture 56. The filter 58 may be formed of fiberglass, polyester (woven or non-woven), cotton, electrostatic material, high efficiency particulate air (HEPA) materials. The filter 58 may include an N95, N99, or an N100 rating. The filter 58 may include a MERV rating of 16 or below, 14 or below, 12 or below, 10 or below, 8 or below, 6 or below, or 4 or below. Therefore, depending on an end-use, an appropriate filter 58 may be selected. For example, in a commercial environment it may be beneficial to include a filter 58 formed of non-woven polyester and with a rating of N95. In some embodiments, the floor aperture 56 and the filter 58 may be circular-shaped. However, it should be appreciated that the floor aperture 56 and the filter 58 may be other shapes such as rectilinear.

Figure 3:
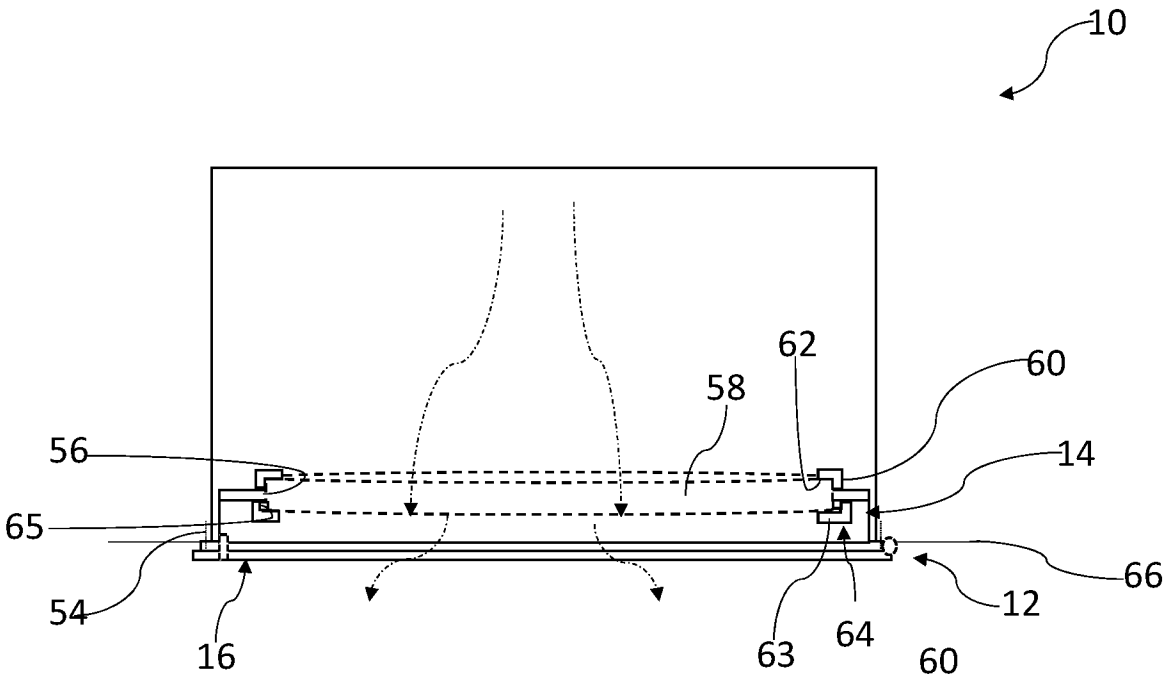
FIG. 3 is a cross-sectional side view of the air diffuser assembly according to an aspect of the present disclosure.

With reference now to FIG. 3, a cross-section of the air diffuser assembly 10 is illustrated. The filter 58 may be retained within the floor aperture 56 via a sleeve 60 that extends from one or both sides of the floor 44 between a cavity side that faces the cover 16 and a HVAC side that faces into the interior of the duct. In some embodiments, the sleeve 60 is annularly shaped for housing the filter 58, which may be circular. In some embodiments, the HVAC side defines an inwardly directed flange 62 for seating against the filter 58. In some embodiments, the cavity side defines at least one holding device 64, such as a clip, a threaded surface, a cap, or a combination thereof to selectively removed and replace the filter 58. In some embodiments, the holding device 64 includes an annular cap 63 with a threaded inner or outer surface and the sleeve 60 includes a threaded inner or outer surface for threaded engagement 65 with the annular cap 63. FIG. 3 further illustrates the air diffuser assembly 10 located within a wall 66 of a commercial or residential space. In some embodiments, the hinge 52 is located adjacent to one of the peripheral sidewalls 22 and an outer portion of the top flange 46 of the body 14.

Figure 4:
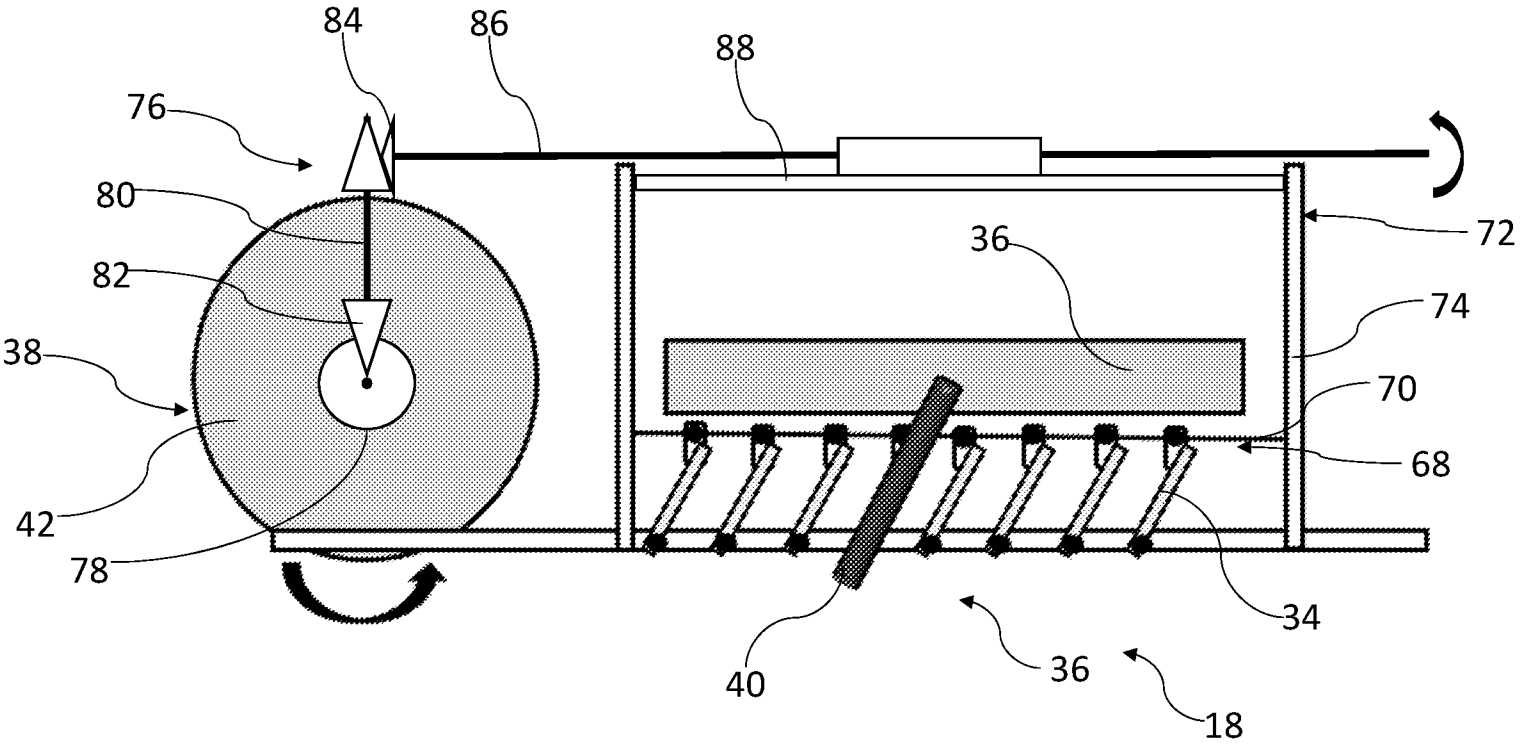
FIG. 4 is a cross-sectional side view of a vent in the air diffuser assembly according to an aspect of the present disclosure.
Figure 5:
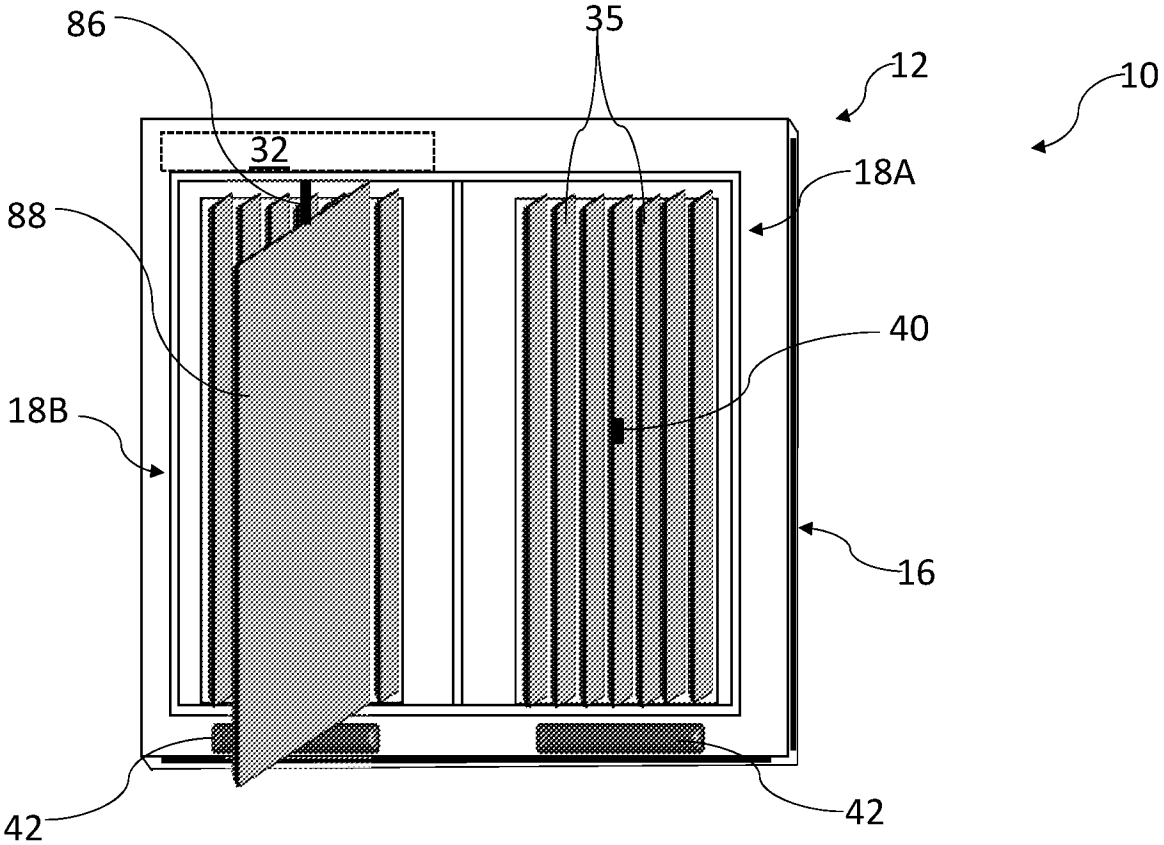
FIG. 5 is a bottom view of a cover of the air diffuser assembly according to an aspect of the present disclosure.

With reference now to FIG. 4, the vent assembly 18 is illustrated from a cross-sectional perspective in accordance with some embodiments. The directional control 36 is illustrated as connected to the outer blades 34 and the inner blades 35. More particularly, the tab 40 of the directional control 36 may be slideably connected to one of the outer blades 34 and connected to one of the inner blades 35. The outer blades 34 may be transverse (e.g., perpendicular) to the inner blades 35. As such, in use, the tab 40 may be pivoted in an upward or downward position (e.g., a first bi-directional axis) to orientate the outer blades 34 and slid in a cross-wise direction (e.g., a second bi-directional axis) to orient the inner blades 35. The outer blades 34 may be connected to the cover 16 via a pivot linkage 68 that includes at least one elongated member 70 and portion of the cover 16 located and pivotally connected on opposite sides of the outer blades 34. A similar pivot linkage (not shown) may be included for movement of the inner blades 35. Each vent 18 may further include a vent gateway 72 that includes a plurality of sidewalls 74 extending about the vent 18 into the cavity 50. In some embodiments, the flow adjustment wheel 42 may be connected to the adjustment flow valve 37 via a gear mechanism 76. In some embodiments, the gear mechanism 76 may include a first bevel gear 78 connected to the flow adjustment wheel 42 and a shaft 80 with a pair of oppositely located shaft gears 82 and a second bevel gear 84 rotationally connected to a valve shaft 86. A valve plate 88 may be connected to the valve shaft 86. As such, rotation of the flow adjustment wheel 42 causes similar rotation of the valve shaft 86 and the valve plate 88. FIG. 5 illustrates a bottom view of the cover 16 from FIG. 1. The flow valve 37 is removed from one of the vents 18 for illustrating the connection between the tab 40 and one of the inner blades 54. In some embodiments, a vent gateway 72 may be located around more than one vent assembly 18 and the valve plate 88 may control the flow rate to more than one vent assembly 18.

Figure 7:
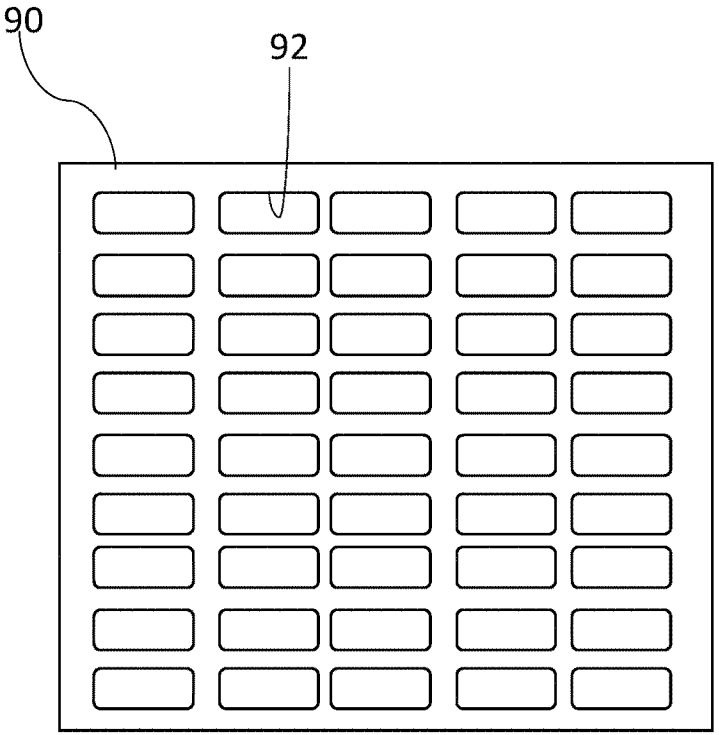
FIG. 7 is a top view of the grate according to an aspect of the present disclosure.
Figure 6:
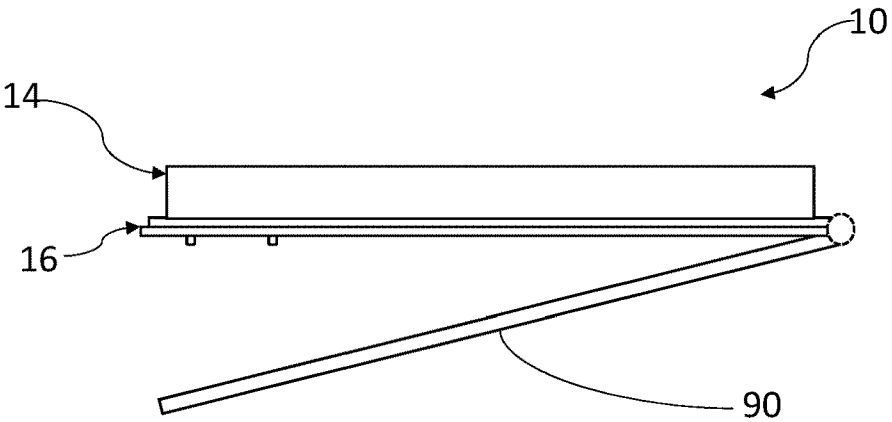
FIG. 6 is a side view of an air diffuser assembly with a protective grate according to an aspect of the present disclosure.

FIGS. 6 and 7 illustrate an air diffuser assembly 10 having a protective grate 90. The protective grate 90 may be connected to the hinge 52 and moveable between a protective position (FIG. 7), wherein protective grate 90 is located over the cover 16 and protects various parts thereof (e.g., the vent assembly 18 or the user interface 24) and a non-protective position (FIG. 6), wherein protective grate 90 is moved or pivoted away from the cover 16 and permits access to various parts thereof (e.g., the vent 18 or the user interface 24). The protective grate 90 may be particularly useful when installed into a floor and may define a series of air holes 92 for permitting the air to pass therethrough.

Figure 8:
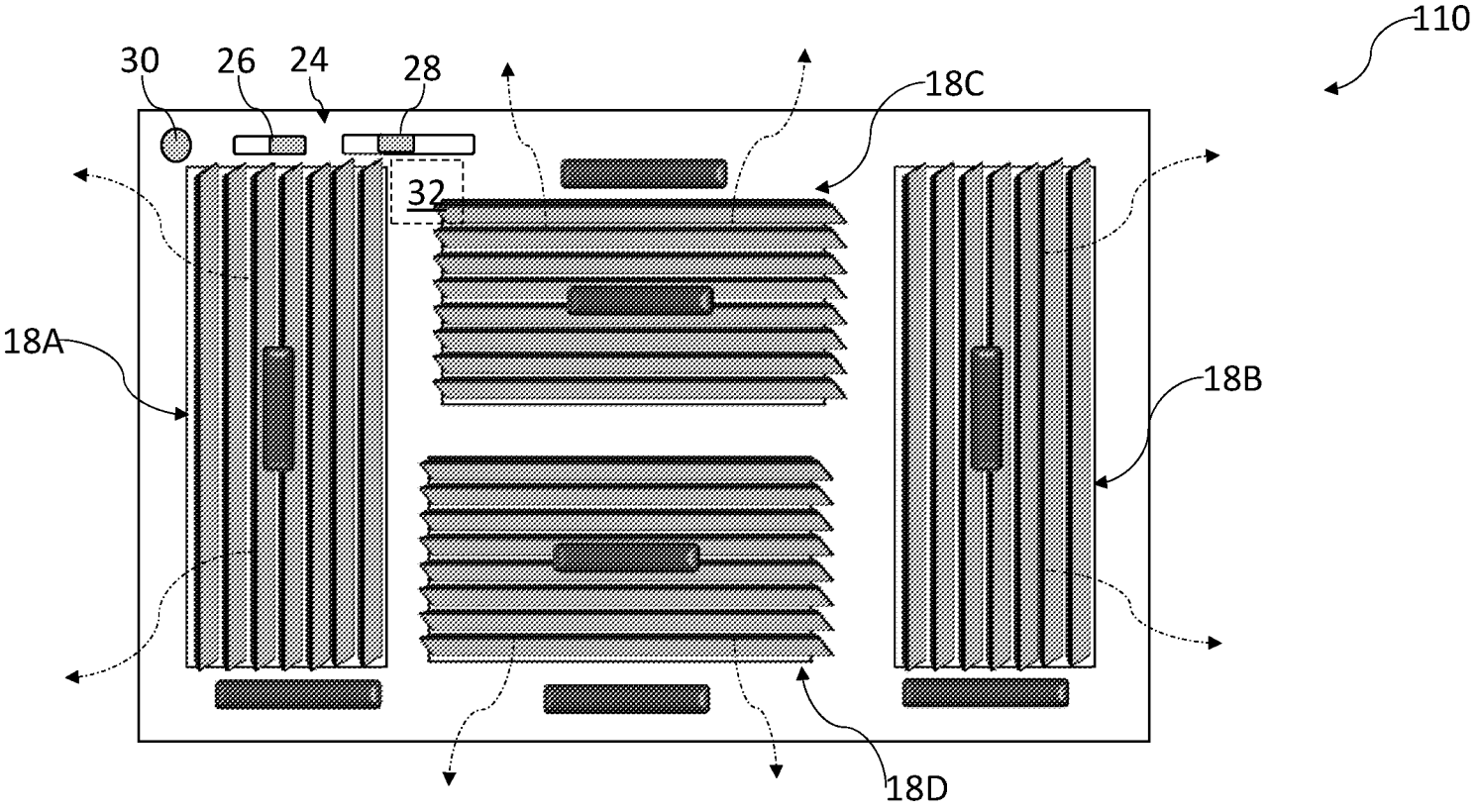
FIG. 8 is top view of a second embodiment of the air diffuser assembly according to an aspect of the present disclosure.

FIG. 8 illustrates a second embodiment of the air diffuser assembly 110. Unless otherwise detailed, the second embodiment may share all of the same features, materials, and constructions as the first embodiment. However, the orientation and number of the vents 18 of the second embodiment have been changed from the first embodiment. More particularly, the air diffuser assembly 110 includes a pair of vertical vents 18A, 18B spaced from one another and a pair of horizontal vents 18C, 18D located there between.

Figure 9:
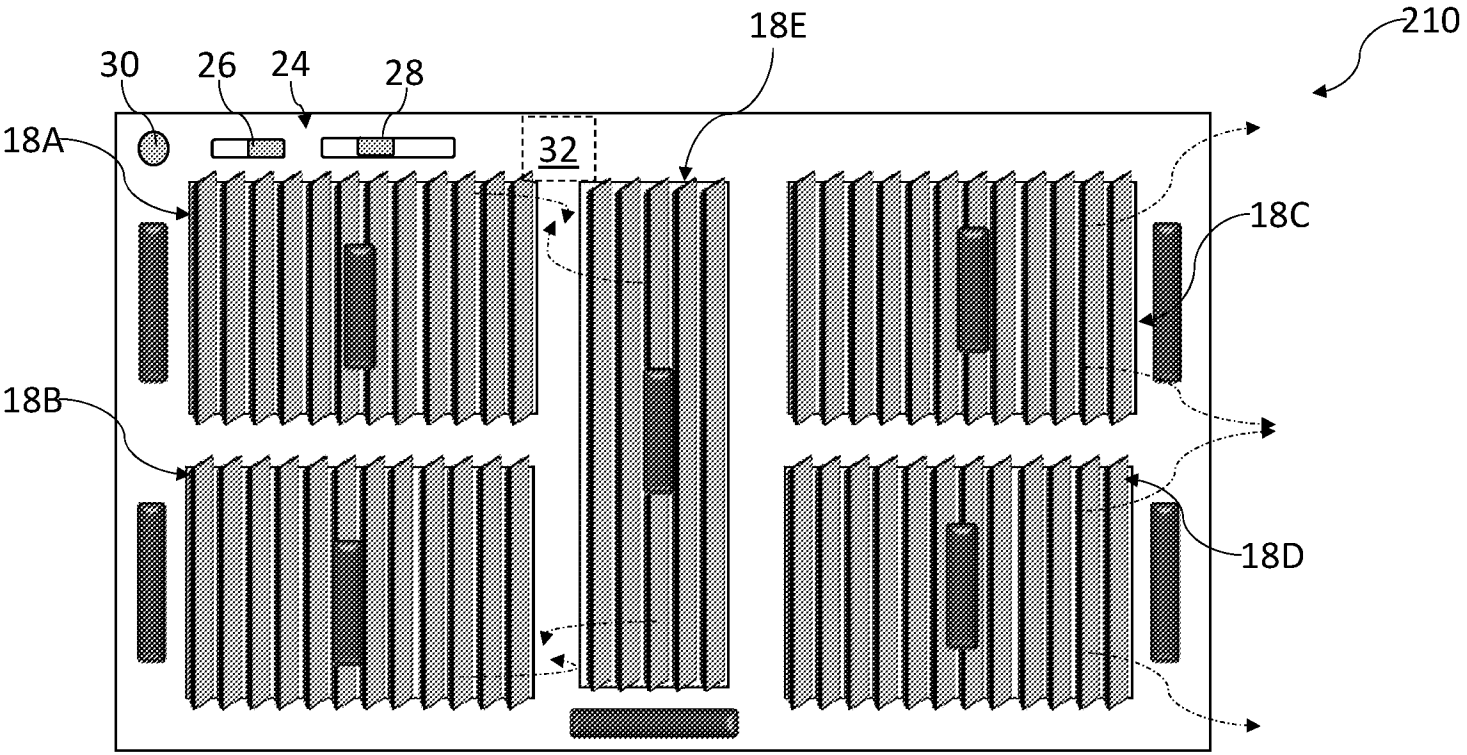
FIG. 9 is top view of a third embodiment of the air diffuser assembly according to an aspect of the present disclosure.

FIG. 9 illustrates a third embodiment of the air diffuser assembly 210. Unless otherwise detailed, the third embodiment may share all of the same features, materials, and constructions as the first embodiment. However, the orientation and number of the vents 18 of the third embodiment have been changed from the first and second embodiments. More particularly, the air diffuser assembly 100 includes a pair of horizontal vents 18A, 18B spaced from another pair of horizontal vents 18C, 18D and a vertical vent 18E located there between.

Figure 10:
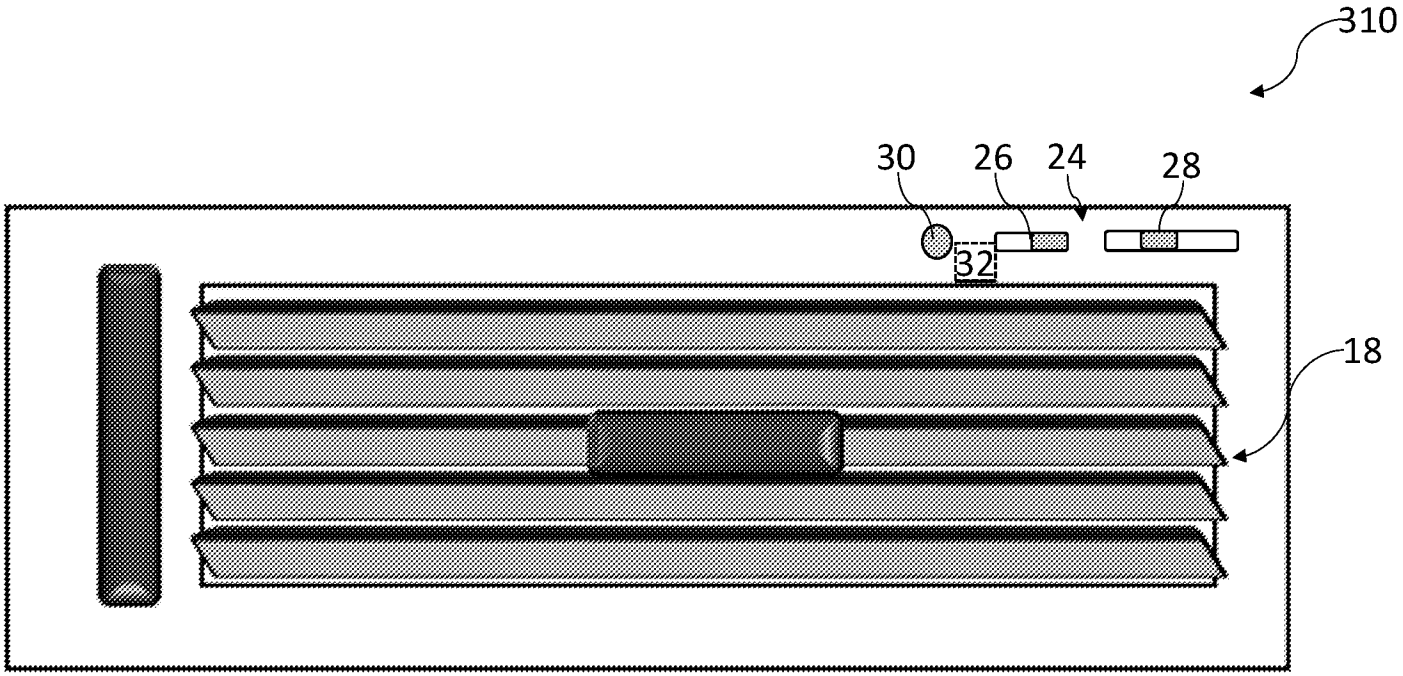
FIG. 10 is top view of a fourth embodiment of the air diffuser assembly according to an aspect of the present disclosure.

FIG. 10 illustrates a fourth embodiment of the air diffuser assembly 310. Unless otherwise detailed, the fourth embodiment may share all of the same features, materials, and constructions as the first embodiment. However, the orientation and number of the vents 18 of the fourth embodiment have been changed from the other embodiments. More particularly, the air diffuser assembly 100 includes a single vent 18.

The variations of the orientation and number of the vents 18 may each be beneficial for various environments. For example, the air diffuser 10 may be beneficial in circumstances with two or more persons located (e.g., working) on opposite sides thereof, the air diffuser assembly 110, 210 may be beneficial in circumstances with four or more persons located on opposite sides thereof, and the air diffuser assembly 310 may be beneficial in circumstances with one person.

Many modifications and variations of the present invention are possible in light of the above teachings and may be practiced otherwise than as specifically described. In addition, the reference numerals are merely for convenience and are not to be read in any way as limiting. Note that not all of the activities described above in the general description or the examples are required, that a portion of a specific activity may not be required, and that one or more further activities may be performed in addition to those described. Still further, the orders in which activities are listed are not necessarily the order in which they are performed. The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Furthermore, certain features are, for clarity, described herein in the context of separate embodiments, may also be provided in combination in a single embodiment. Conversely, various features that are, for brevity, described in the context of a single embodiment, may also be provided separately or in any sub combination.

What is claimed:

1. An air diffuser assembly for transferring airflow from a duct to an environment, the air diffuser assembly comprising:

a body for being at least partially located in the duct and a cover including at least one vent assembly for permitting the airflow through the cover and into the environment;

the body defining an aperture for transferring the airflow from the duct and an air filter located in the aperture;

the cover including a closed position, wherein the cover is placed against the body to form a cavity, and an open position, wherein the cover is moved from the body to permit access to the filter;

wherein the cover includes an outer peripheral sidewall defining a thickness and a source of illumination is located on the outer peripheral sidewall; and wherein the cover further includes a user interface that includes a setting selector and a brightness selector.

2. The air diffuser assembly of claim 1, wherein a sleeve surrounds the aperture for retaining the filter.

3. The air diffuser assembly of claim 2, wherein the sleeve includes an HVAC side for orientation towards the duct and a cavity side oriented towards the cover and wherein the HVAC side includes an inwardly directed flange for seating against the filter.

4. The air diffuser assembly of claim 3, wherein the cavity side of the sleeve includes at least one holding device for keeping the filter seated against the inwardly directed flange.

5. The air diffuser assembly of claim 4, wherein the holding device includes at east one of a clip, a threaded surface, or a cap.

6. The air diffuser assembly of claim 1, wherein the source of illumination extends over a majority of the peripheral sidewall.

7. The air diffuser assembly of claim 1, wherein the setting selector includes at least one of on/off settings for motion sensing, light detection, scheduled illumination, or color of illumination.

8. The air diffuser assembly of claim 1, wherein the cover includes at least one motion sensor for illuminating the source of illumination upon a detection of motion.

9. The air diffuser assembly of claim 1, wherein the cover is pivotally connected to the body via a hinge along a peripheral edge of the cover.

10. The air diffuser assembly of claim 1, wherein the at least one vent assembly includes a plurality of outer blades in operable connection with a directional control to pivot the plurality of outer blades along a first bi-directional airflow axis for directing the airflow therealong.

11. The air diffuser assembly of claim 10, wherein the at least one vent assembly includes a plurality of inner blades oriented in transverse relationship with the outer blades.

12. The air diffuser assembly of claim 11, wherein the plurality of inner blades are in operable connection with the directional control to pivot the plurality of inner blades along a second bi-directional airflow axis for directing the airflow therealong.

13. The air diffuser assembly of claim 12, wherein the directional control includes a tab slideably attached to the one of the plurality of outer blades and connected to one of the plurality of inner blades.

14. The air diffuser assembly of claim 10, wherein the at least one vent assembly includes a flow control in operable connection with a valve plate for controlling a flow rate through the at least one vent assembly.

15. The air diffuser assembly of claim 14, wherein the flow control includes a flow adjustment wheel in operable connection with the valve plate.

16. The air diffuser assembly of claim 15, wherein an inner side of the cover defines a vent gateway and the valve plate is located within the vent gateway.

17. The air diffuser assembly of claim 16, wherein the at least one vent assembly includes a plurality of vent assemblies, at least two of which including an independent one of the vent gateways and one of the valve plates for controlling the airflow through the at least two vent assemblies independently.

18. The air diffuser assembly of claim 1, wherein the filter includes at least a N95 rating or above.

* * * * *